US008776386B2

(12) United States Patent
Kingsbury et al.

(10) Patent No.: US 8,776,386 B2
(45) Date of Patent: Jul. 15, 2014

(54) BOW SIGHT WITH LIGHT GATHERING POINT SHAPED PINS, ILLUMINATED YARDAGE INDICIA, AND INDIVIDUAL PIN MICRO-ADJUSTMENT

(76) Inventors: Klint McLean Kingsbury, Austin, TX (US); Clayton W. Reinarz, New Braunfels, TX (US)

( * ) Notice: Subject to any disclaimer, the term of this patent is extended or adjusted under 35 U.S.C. 154(b) by 216 days.

(21) Appl. No.: 13/466,083

(22) Filed: May 7, 2012

(65) Prior Publication Data

US 2013/0118019 A1 May 16, 2013

Related U.S. Application Data

(60) Provisional application No. 61/482,739, filed on May 5, 2011.

(51) Int. Cl.
*F41G 1/467* (2006.01)

(52) U.S. Cl.
CPC ..... *F41G 1/467* (2013.01)
USPC ..... 33/265; 124/87

(58) Field of Classification Search
CPC ..... F41G 1/467
USPC ..... 33/265; 124/87
See application file for complete search history.

(56) References Cited

U.S. PATENT DOCUMENTS

| | | | | |
|---|---|---|---|---|
| 3,822,479 | A * | 7/1974 | Kowalski | 33/265 |
| 4,495,705 | A | 1/1985 | Kowalski et al. | |
| 4,535,747 | A * | 8/1985 | Kudlacek | 124/87 |
| 4,813,150 | A | 3/1989 | Colvin | |
| 4,910,874 | A * | 3/1990 | Busch | 33/265 |
| 5,168,631 | A | 12/1992 | Sherman | |
| 5,228,204 | A * | 7/1993 | Khoshnood | 33/265 |
| 5,231,765 | A | 8/1993 | Sherman | |
| 5,367,780 | A * | 11/1994 | Savage | 33/265 |
| 5,862,603 | A | 1/1999 | Ellig | |
| 6,508,005 | B2 * | 1/2003 | Springer | 33/265 |
| 6,634,110 | B2 * | 10/2003 | Johnson | 33/265 |
| D522,083 | S | 5/2006 | Afshari | |
| 7,086,161 | B2 | 8/2006 | Ellig et al. | |
| 7,290,345 | B2 | 11/2007 | Ellig | |
| D562,427 | S | 2/2008 | Khoshnood | |
| 7,392,590 | B2 * | 7/2008 | Gordon | 33/265 |
| 7,503,321 | B2 | 3/2009 | Afshari | |
| 7,549,230 | B2 | 6/2009 | Rager | |
| 7,574,811 | B2 * | 8/2009 | Kurtzhals et al. | 33/265 |
| 7,578,067 | B2 * | 8/2009 | Rager | 33/265 |
| 7,603,784 | B2 | 10/2009 | Erhard | |
| 7,698,824 | B2 | 4/2010 | Wilson | |
| 7,796,329 | B2 | 9/2010 | Dobschal et al. | |

(Continued)

*Primary Examiner* — Christopher Fulton
(74) *Attorney, Agent, or Firm* — Kammer Browning PLLC

(57) ABSTRACT

A bow sight with light gathering point shaped pins with illuminated yardage indicia. The point shaped pins are individually adjustable with both gross set point adjustments and micro set point adjustments. The sight pins are structured as plates stacked within a pin housing supported by an adjustment bracket connecting to a riser mount secured to the bow stock. The light gathering sight and structures provide brighter illumination while retaining a fine resolution point along with illuminated yardage indicators facing towards the archer. Each of the sight pins is grossly adjustable in a vertical orientation and finely adjustable through separate sets of adjustment bolts. The pin housing surrounds the sight pin tips to form a sight window through which the archer may aim the bow. Structures are provided on the external surface of the surrounding pin housing to support Picatinny Rails for accessory attachments.

20 Claims, 8 Drawing Sheets

(56) References Cited

U.S. PATENT DOCUMENTS

| | | | | |
|---|---|---|---|---|
| 7,832,109 | B2 | 11/2010 | Gibbs | |
| 7,921,570 | B1 | 4/2011 | Pulkrabek et al. | |
| 7,997,261 | B2 | 8/2011 | Scaniffe | |
| 8,046,927 | B1 | 11/2011 | Edmundson | |
| 8,079,153 | B2 | 12/2011 | Pulkrabek et al. | |
| 8,099,874 | B2 | 1/2012 | Priebe | |
| 8,245,409 | B2 | 8/2012 | Varner et al. | |
| 2002/0083602 | A1* | 7/2002 | Slates | 33/265 |
| 2005/0183272 | A1* | 8/2005 | Meadows | 33/265 |
| 2008/0235962 | A1* | 10/2008 | Sims et al. | 33/265 |
| 2010/0281701 | A1 | 11/2010 | Afshari | |
| 2011/0271536 | A1 | 11/2011 | Logsdon | |
| 2011/0271943 | A1 | 11/2011 | Maynard | |
| 2011/0296699 | A1 | 12/2011 | Mainsonneuve et al. | |
| 2012/0042528 | A1 | 2/2012 | Edmundson | |

* cited by examiner

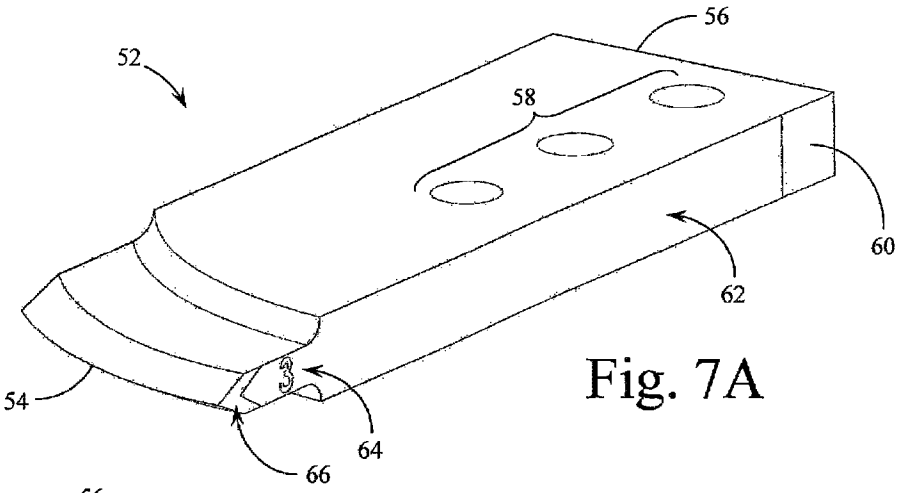
Fig. 7A
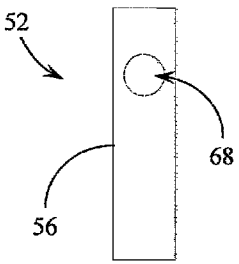
Fig. 7D
Fig. 7C
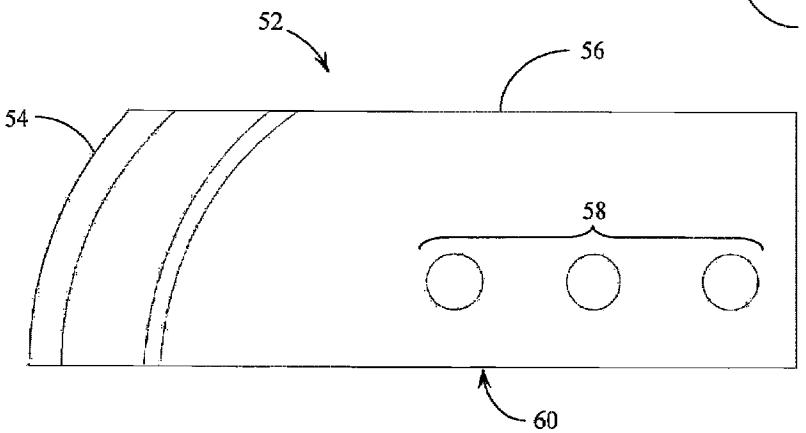
Fig. 7B
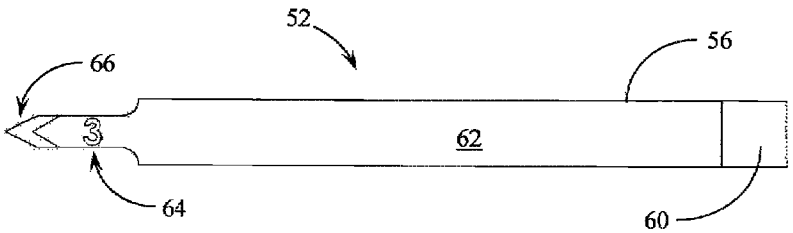

BOW SIGHT WITH LIGHT GATHERING POINT SHAPED PINS, ILLUMINATED YARDAGE INDICIA, AND INDIVIDUAL PIN MICRO-ADJUSTMENT

CROSS REFERENCES TO RELATED APPLICATIONS

This application claims the benefit under Title 35 United States Code §119(e) of U.S. Provisional Patent Application Ser. No. 61/482,739, filed May 5, 2011, the full disclosure of which is incorporated herein by reference.

BACKGROUND OF THE INVENTION

1. Field of the Invention

The present invention relates to archery bows and to bow sights. The present invention relates more specifically to a bow sight with light gathering point shaped pin structures, illuminated yardage indicia, secure pin retention, and individual pin micro-adjustment.

2. Description of the Related Art

Traditional bow sights utilize circular polystyrene or acrylic fibers to gather light and project light toward the archer's eye from the tip of the circular fiber. These circular fibers are usually suspended by a metal or plastic pin. Traditional sights utilize from one to seven or more of these fibers suspended on pins to represent the various distance yardages of arrow impact. The different yardages are frequently represented by different color fibers. These pins are usually held in slots and are tightened and adjusted with an end bolt in the slot. This traditional sight configuration poses three major problems:

The first problem relates to the fiber/point size. The larger the diameter of the fiber, the larger the fiber surface area, and thus the more light it gathers for increased brightness. However, the larger the diameter of the fiber the less accuracy it provides the archer. With a smaller fiber, accuracy increases but brightness decreases. An archer (especially a bow hunter) desires both accuracy and brightness.

The second problem relates to identification of the various yardage pins. Traditional sights with multiple fiber optic pins become confusing as to which fiber represents which arrow impact distance. Remembering that a specific color represents a specific distance can be difficult, especially in a high stress situation like a tournament or hunting.

The third problem relates to secure retention of the sight pin coupled with the ability to finely adjust the sight pin position. The end bolt in a slot utilized to adjust the pins up and down for their individual distances is a very inaccurate form of adjustment. As the bolt is loosened to adjust the pin, the pin can slip and move further or less than the archer desired. This can make it very difficult to precisely adjust the yardage points in the sight.

The proposed invention solves these three problems in the following ways:

First, the present invention provides both increased light gathering and a sharp targeting pin point. The complete pins are formed from light gathering material, such as polystyrene, plastic or acrylic. The tips of these light gathering pins are formed into a pointed edge. This pointed edge on each pin allows the shooter to have the extreme precision of a point for aiming. Since the complete body of the pin is gathering light with more combined surface area than standard sight fibers, it is also extremely bright.

Second, the present invention provides a clear indication of the specific yardage associated with each sight pin. The edges of the pins that face the archer are coated in a dark color, preferably black. A small edge is left uncoated at the very edge for a bright aiming tip. The corresponding arrow impact yardage is also left uncoated in the form of the corresponding number. In this manner the yardage number also shines towards to the archer to eliminate pin yardage confusion.

Finally, the present invention provides both secure retention of the sight pins in the targeting field of view, and the ability to finely adjust the position of the sight pins in the field of view. The pins have end bolts in slots for securing them into the housing. However the assembly also includes vertical micro-adjusting bolts. These bolts are designed to slowly and precisely move the pins individually up and down in the housing. This greatly improves the accuracy and stability of each sight pin.

SUMMARY OF THE INVENTION

The present invention therefore provides a bow sight with a number of light gathering point shaped pins with illuminated yardage indicia. The point shaped pins are individually adjustable within the targeting field of view with both gross set point adjustments and micro set point adjustments. The sight pins (up to seven typically) are structured as plate like structures stacked within a pin housing that is supported by an adjustment bracket connected to a riser mount secured to the bow stock. The light gathering sight pin structures provide brighter illumination while retaining a sharp resolution point along with illuminated yardage indicators facing towards the archer. Each of the sight pins is grossly adjustable and finely adjustable in a vertical orientation through separate sets of securing and adjustment bolts. The pin housing surrounds the sight pin tips to form a sight window through which the archer may aim the bow. Structures are also provided on the external surface of the open pin housing to support Picatinny Rails for accessory attachment.

BRIEF DESCRIPTION OF THE DRAWINGS

FIGS. 7A-7D are detailed views of a typical rear sight pin structure of the point bow sight device of the present invention.

DETAILED DESCRIPTION OF THE PREFERRED EMBODIMENTS

Figure 1:
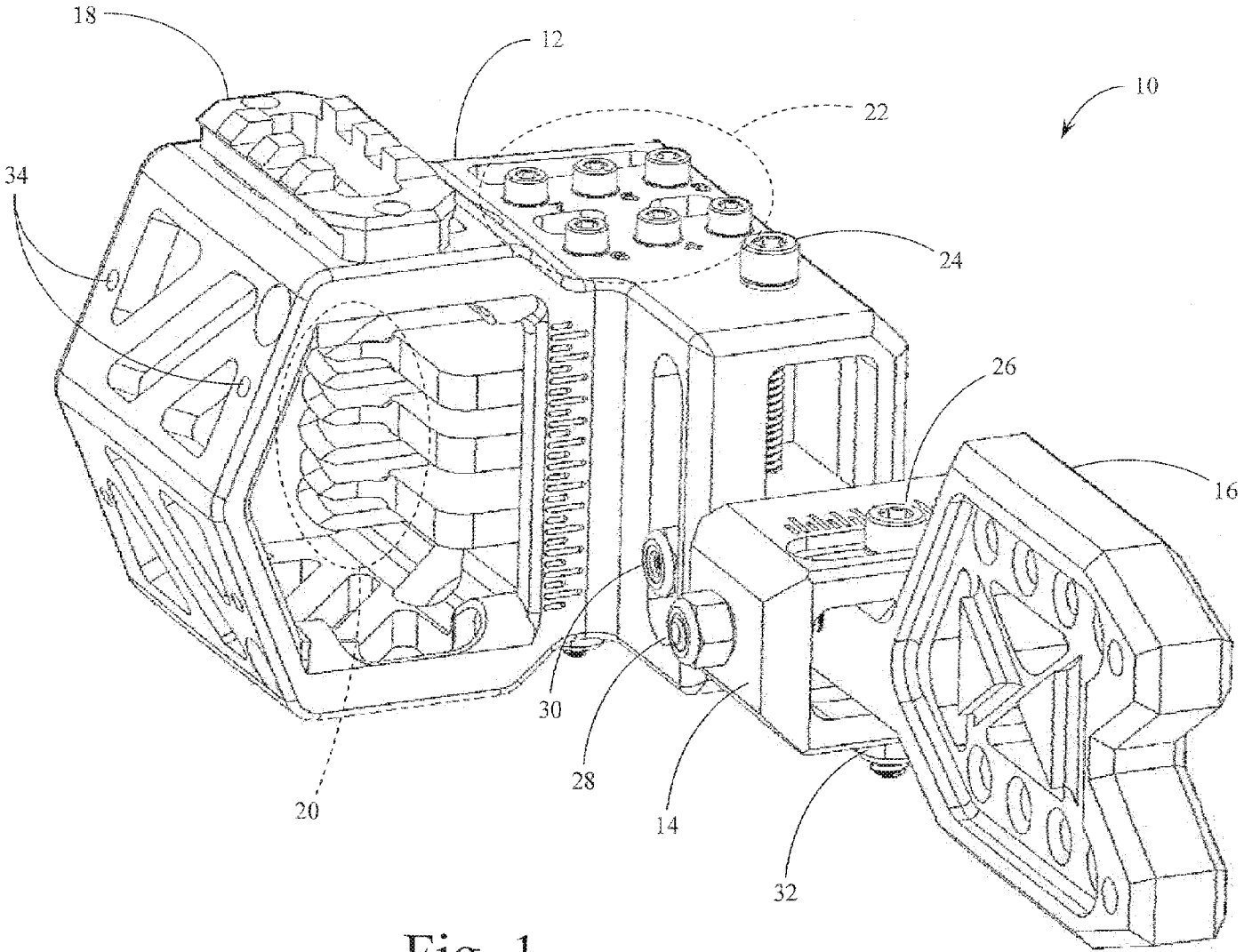
FIG. 1 is a front side perspective view of the point bow sight assembly of the present invention.
Figure 2:
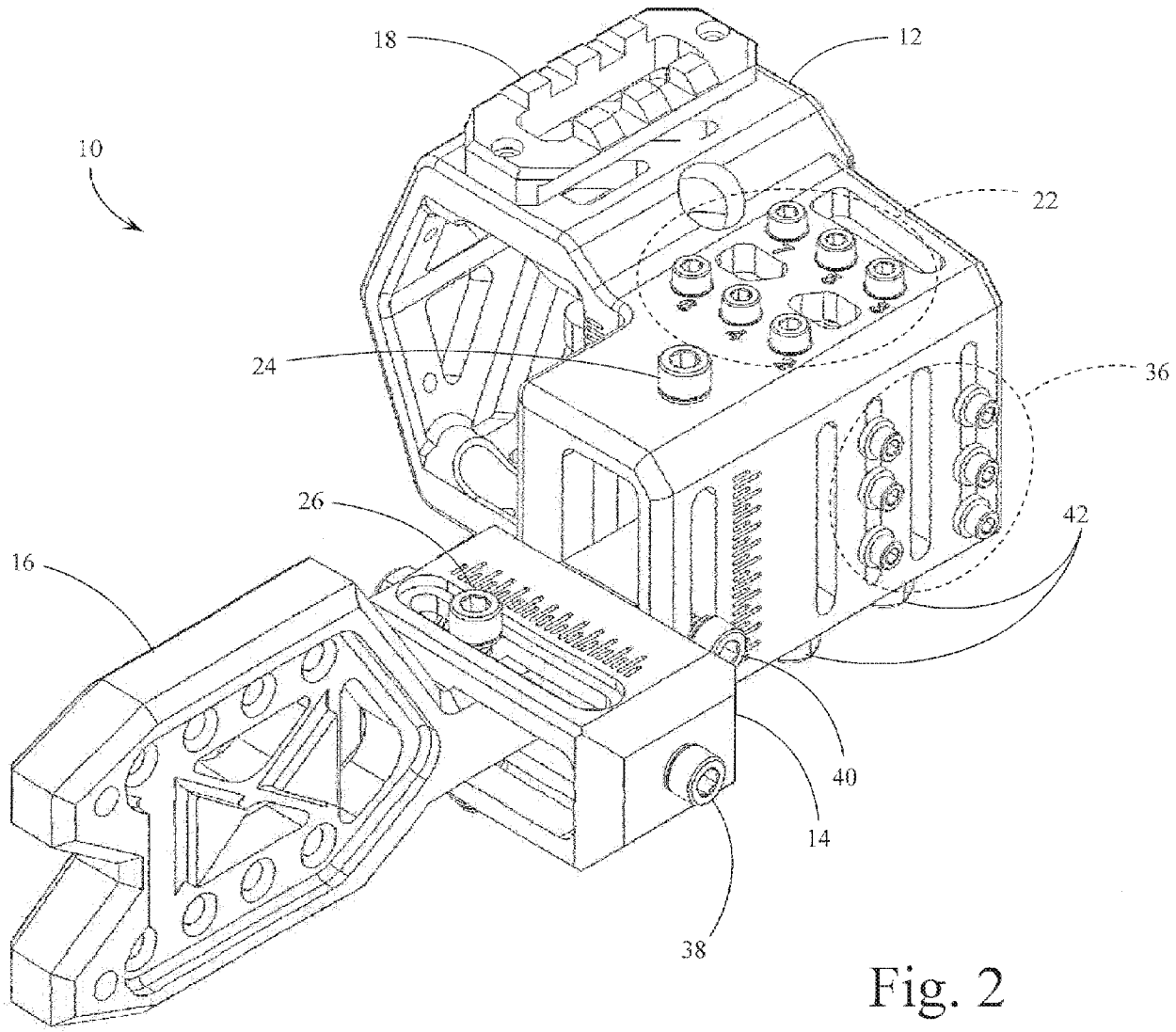
FIG. 2 is a back side perspective view of the point bow sight assembly of the present invention.
Figure 3:
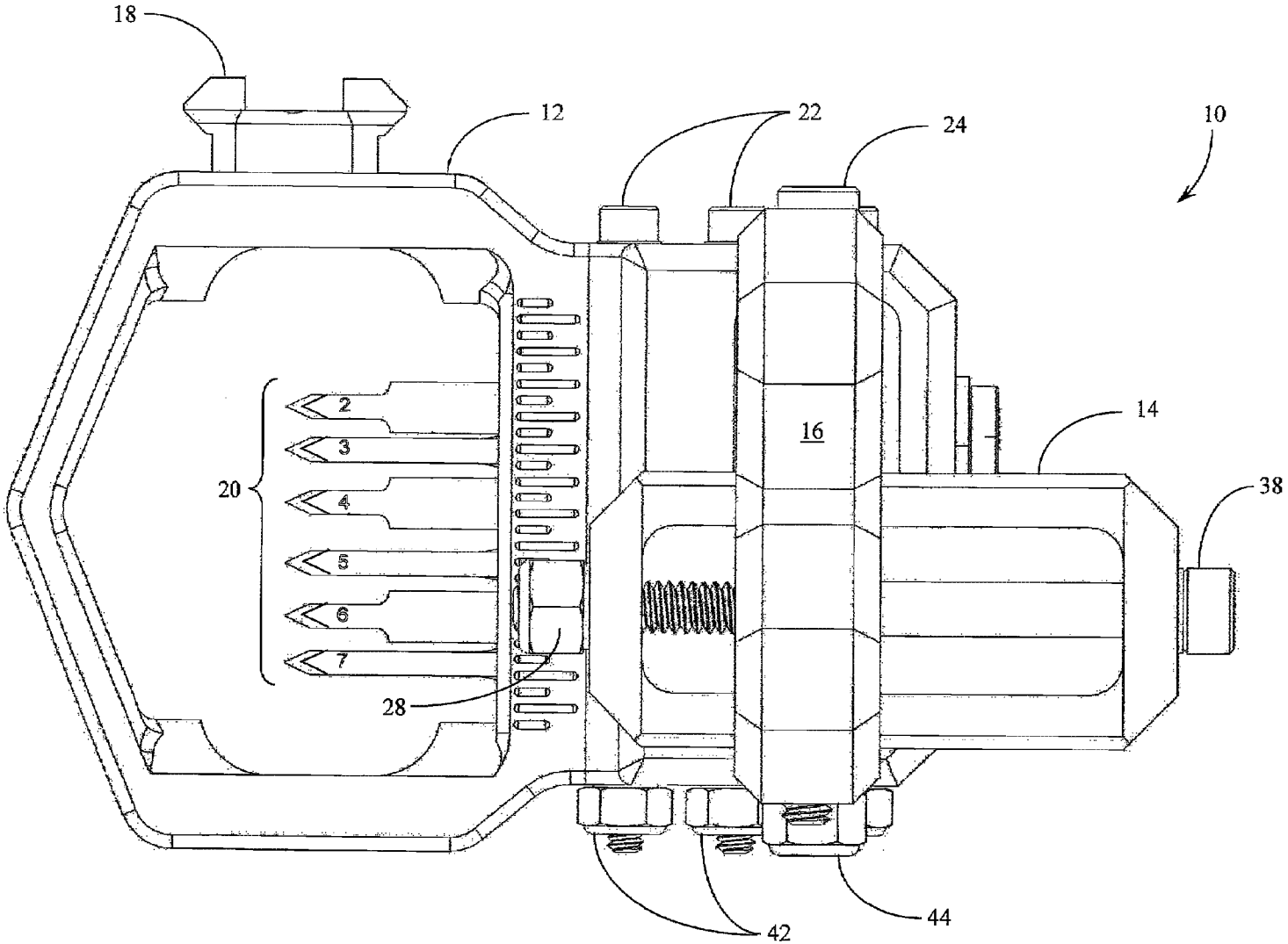
FIG. 3 is a front face elevational view of the point bow sight assembly of the present invention.
Figure 4:
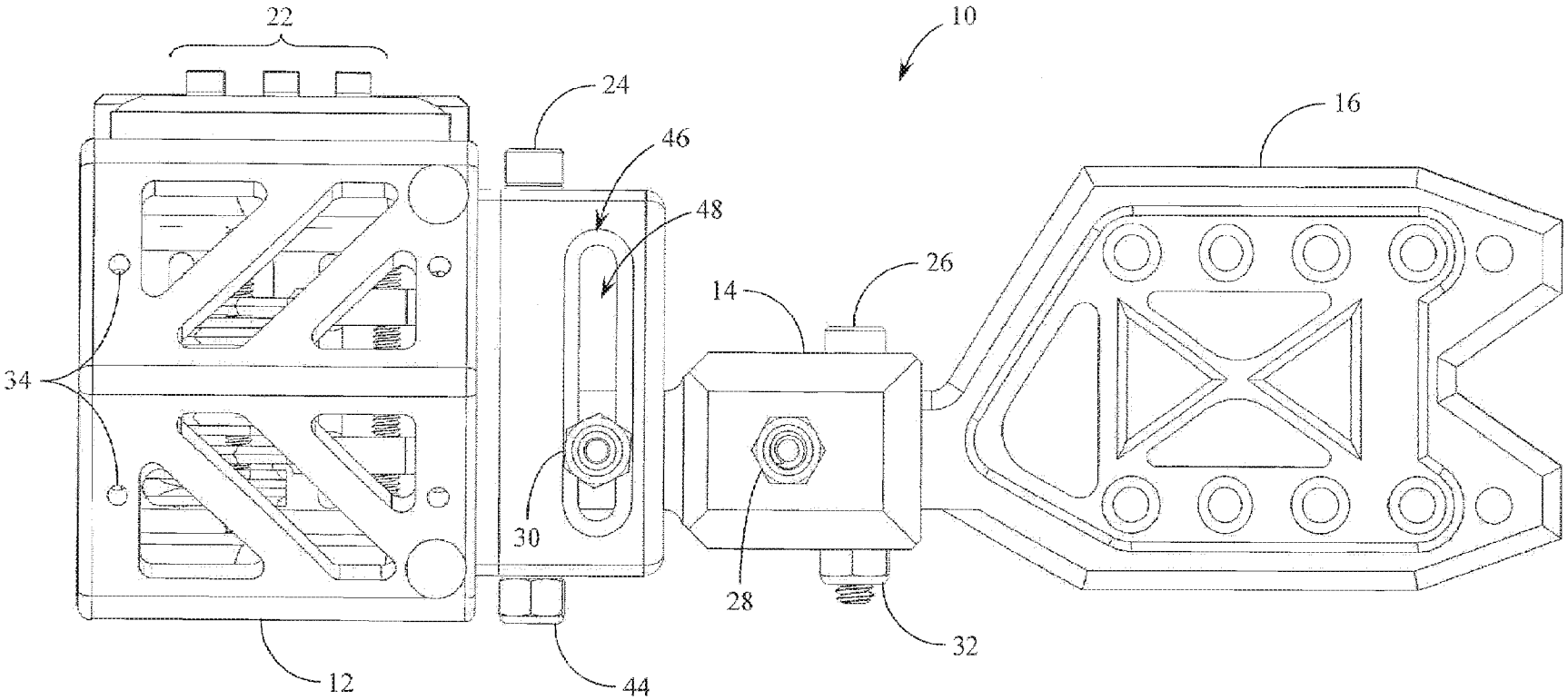
FIG. 4 is a front side elevational view of the point bow sight assembly of the present invention.
Figure 5:
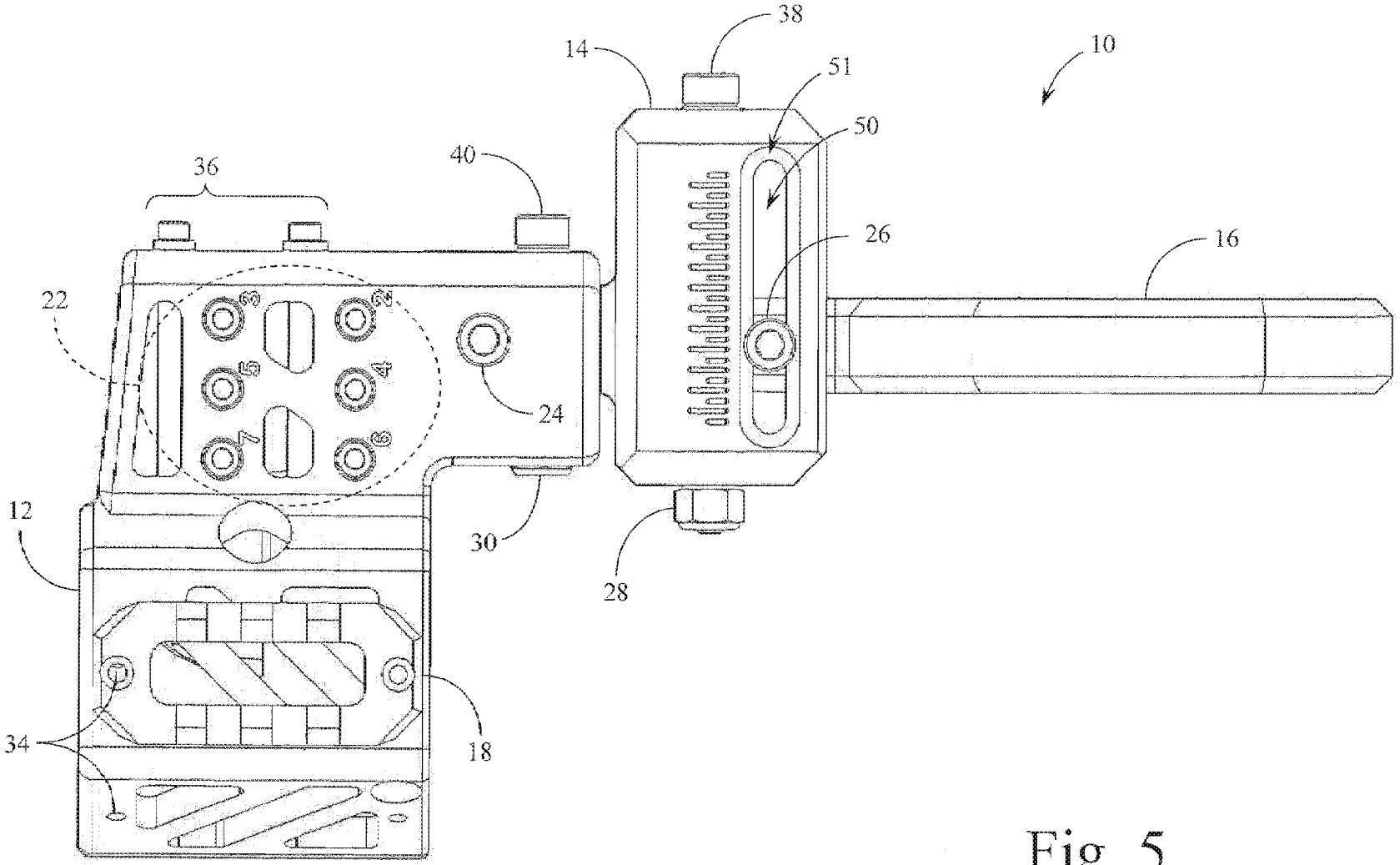
FIG. 5 is a top plan view of the point bow sight assembly of the present invention.
Figure 6:
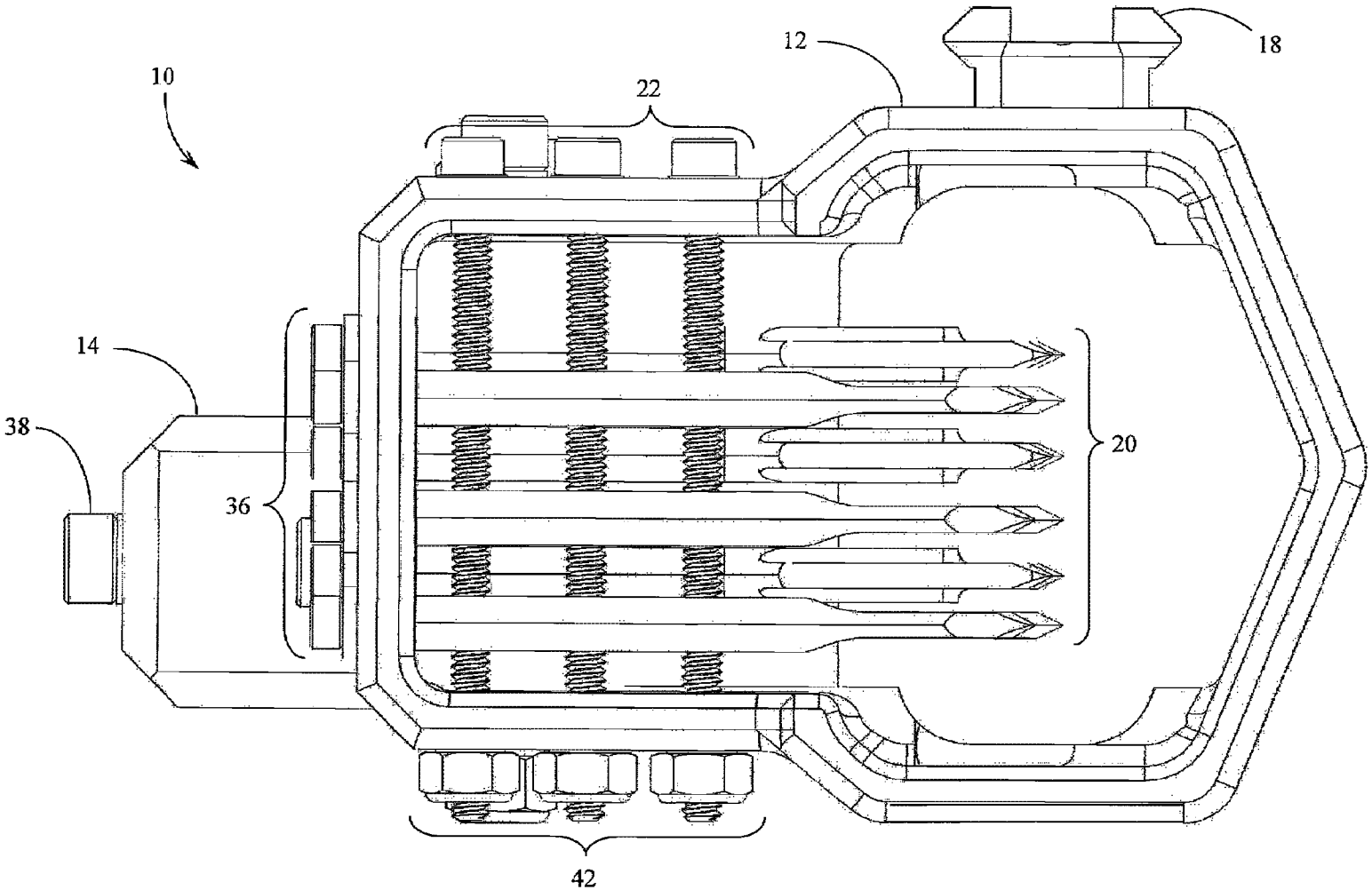
FIG. 6 is a back face elevational view of the point bow sight assembly of the present invention.

Reference is made first to FIGS. 1-6 for various views of the full assembly of the point bow sight of the present invention. There are four primary components to the point bow sight assembly 10; sight pin housing 12, gang adjust bracket 14, riser mount 16, and the multiple yardage aiming points 20.

The assembly of the present invention includes one to seven sight pins 20, although more could be utilized. The sight pins 20 are formed from acrylic, polystyrene or any other type of self illuminating (light gathering) material. The sight pins 20 are preferably (but not necessarily) one to three inches in length. All sight pins 20 should be the same length so as to form a vertical column in the field of view. Each sight pin 20 is formed with a point.

FIGS. 7A-7D provide detailed views of one of the rear sight pin structures of the point bow sight device of the present invention. In the example shown in FIGS. 1-6, the point bow sight incorporates six sight pins, three front sight pins and three rear sight pins, alternating in the stacked arrangement shown. The sight pin coating 62 (in FIGS. 7A-7D) is formed from any dark coating (paint, plastic, film) and applied so that it forms the yardage number 64 and the aiming point 66. The aiming point 66 can be formed into any type of arrow or triangle. The micro-adjustment holes 58 can be threaded into the self illuminating material of the rear sight pin 52 or threaded inserts can be utilized. Only one hole in each rear sight pin 52 will contain threads to accommodate a micro-adjustment bolt 22. The remaining holes will be smooth to accommodate the other bolts that do not move the rear sight pin 52. The end of the rear sight pin 52 (see FIG. 7D) will also be either directly threaded or utilize a threaded insert to accommodate the pin securing bolt 36. The micro-adjustment bolts 22 are held securely into the pin housing 12 by the lock nut micro-adjustment bolts 42.

Referring again to FIGS. 1-6, the vertical micro-gang adjustment bolt 24 is of adequate length to run through the gang adjust bracket 14, and is secured by the vertical micro-adjust lock nut 44. The vertical securing bolt 40 is of adequate length to run through the gang adjust bracket 14 in the vertical securing bolt slot 46 and is secured by the vertical securing nut 30 in the vertical securing nut slot 48. The horizontal micro-gang adjustment bolt 38 is of adequate length to run through the gang adjust bracket 14, and is secured by the horizontal micro-adjust lock nut 28. The horizontal securing bolt 26 is of adequate length to run through the gang adjust bracket 14 in the horizontal securing bolt slot 50 and is secured by the horizontal securing nut 32.

Pin housing 12 is constructed of (but not necessarily limited to) plastic, polymer, composite or alloy. Its shape generates protection for the sight pins 20 and supports the micro-adjustment bolts 22 and the pin securing bolts 36. Gang adjustment bracket 14 is constructed of (but not necessarily limited to) plastic, polymer, composite or alloy. It supports the bolts used for micro gang adjustment and securing. The hole for the vertical micro-gang adjustment bolt 24 is directly threaded or utilizes an insert. The rest of the holes are smooth.

The riser mount 16 is constructed of (but not necessarily limited to) plastic, polymer, composite or alloy. It supports the horizontal micro-gang adjustment bolt 38 with a threaded hole or insert. The hole for the horizontal securing bolt 26 is smooth. The view through point sight shows the multiple yardage aiming points 20. The Picatinny Rail mount holes 34 will accommodate bolts that fasten the bolt-on Picatinny Rails 18. One such Picatinny Rail is shown in FIG. 1 although the structure of the embodiment shown provides for the placement of three additional rails spaced around the outside surface of the field of view section of the pin housing 12. This field of view section of the housing may be structured with a different geometry that allows for more or fewer rail placements.

Necessary components of the assembly include the structure of each of the rear sight pins 52, the sight pin coating 62, the aiming point 66, and the yardage number indicia 64. These elements are necessary to provide a lighted aiming point with a visible yardage indicator. The pin housing 12 is required to hold the sight pins 20. The micro-adjustment bolts 22, vertical micro-gang adjustment bolt 24, horizontal micro-gang adjustment bolt 38, and gang adjust bracket 14 are optional features that provide preferred adjustment and precision. The bolt-on Picatinny Rails 18 are optional features that allow the mounting of accessories to the sight. Additional micro-adjustment mechanisms could be added to the sight to increase adjustability of the aiming points. An LED with associated battery power could be added to the sight for low-light illumination. Tritium could be added to the sight pins 20 for artificial lighting.

As an example, reference is made to FIGS. 7A-7D for a description of the manner in which rear sight pins 52 are used for aiming. With the proposed invention, the aiming point 66 of the rear sight pin 52 is used to generate a very precise aiming tool. The aiming point 66 is formed by the tip of the rear sight pin 52 and the sight pin coating 62. The sight pin coating 62 also forms the yardage number 64. Both the aiming point 66 and the yardage number 64 are generated from the contrast between the dark sight pin coating 62 and the bright light projecting sight pin material.

Referring back to FIGS. 1-6, the sight pins 20 are micro-adjusted up and down within the pin housing 12 by turning the micro-adjustment bolts 22. The micro-adjustment bolts 22 are threaded through one (and only one) of the micro-adjustment holes in each sight pin. The other micro-adjustment bolts 22 travel through a non-threaded micro-adjustment hole in the sight pin. This allows the sight pins 20 to be moved individually up and down by turning a different micro-adjustment bolt 22 for each sight pin 20.

After adjustment is finalized for each sight pin 20, the pin securing bolts 36 are used to tighten and secure the sight pins 20 into place. The pin securing bolts 36 travel up and down in slots in the pin housing 12. The pin housing 12 has a slot that accommodates the gang adjustment bracket 14. The gang adjustment bracket 14 has a threaded hole or threaded insert that interfaces with the vertical micro-gang adjustment bolt 24. The pin housing 12 also supports the vertical micro-gang adjustment bolt 38 and allows it to free spin so that the pin housing 12 is transmitted up and down as the bolt head is turned. The vertical micro-adjust lock nut 44 keeps the vertical micro-gang adjustment bolt 24 tight in the assembly. The pin housing 12 also contains the vertical securing bolt slot 46 and the vertical securing nut slot 48. The vertical securing bolt 40 slides up and down in these slots.

The vertical securing bolt 40 is tightened down to secure the pin housing 12 to the gang adjust bracket 14 once the vertical adjustments have been completed. The vertical securing bolt 40 is tightened down into the vertical securing nut 30. The vertical securing nut 30 is prevented from spinning by the vertical securing nut slot 48. The gang adjust bracket 14 has a slot that accommodates the riser mount 16. The riser mount 16 has a threaded hole or threaded insert that interfaces with the horizontal micro-gang adjustment bolt 38. The gang adjust bracket 14 also supports the horizontal micro-gang adjustment bolt 38 and allows it to free spin so that the pin housing 12 is moved side-to-side as the bolt head is turned. The horizontal micro-adjust lock nut 28 keeps the horizontal micro-gang adjustment bolt 38 tight in the assembly. The gang adjust bracket 14 also contains the horizontal securing bolt slot 50 and the horizontal securing nut slot 51. The horizontal securing bolt 26 slides side-to-side. The horizontal securing bolt 26 is tightened down to secure gang adjust bracket 14 to the riser mount 16 once the horizontal adjustments have been completed. The horizontal securing bolt 26 is tightened down into the horizontal securing nut 32. The horizontal securing nut 32 is prevented from spinning by the horizontal securing nut slot 51. The riser mount 16 also has a smooth hole that accommodates the horizontal securing bolt 26. The riser mount 16 is mounted to the bow using the standard IBO sight holes. The bow is aimed while looking through the view through point sight and using the multiple aiming points 20. The Picatinny Rail mount holes 34 are threaded to accommodate bolts holding the bolt-on Picatinny Rails 18. This allows accessories such as lights, lasers, etc. to be mounted directly to the sight.

The riser mount 16 mounts to the bow using the standard IBO bolt holes. The gang adjust bracket 14 is secured to the riser mount 16 using the horizontal securing bolt 26. The horizontal micro-gang adjustment bolt 38 is turned to move the gang adjustment bracket 14 and thus the sight pins 20 side to side. This function allows the shooter to sight in the windage of the sight pins 20. The pin housing 12 is secured to the gang adjust bracket 14 using the vertical securing bolt 40. The pin housing 12 is moved up and down using the vertical micro-gang adjustment bolt 24. This allows the shooter to sight in the elevation of the top sight pin 20. Each individual sight pin 20 is secured to the pin housing 12 using the pin securing bolts 36. Each individual sight pin 20 is moved vertically using its own micro-adjustment bolt 22 that corresponds to its specific yardage number. Turning the micro-adjustment bolts 22 allows the shooter to precisely adjust the elevation of each individual sight pin 20. The brightly lit yardage numbers are displayed to the shooter through the dark sight pin coatings. The dark sight pin coatings also form the brightly lit triangle or point at the end of the sight pins 20. This point is used by the shooter for precise aiming of the bow. The bolt-on Picatinny Rails 18 can be utilized by the shooter to mount lights, lasers or cameras to the sight. This allows for these mechanisms to be very closely in line with the shooter's line of sight. This is very convenient when hunting from blinds that might disrupt the light path or camera view path if mounted elsewhere on the bow.

The sight pins 20 would be fabricated using injection molding or CNC machining The rest of the components could be fabricated using injection molding, CNC machining, MIMs, casting or die casting. The assembly hardware is standard. All of the bolts used for micro-adjusting may require additional machining for adequate thread length.

An archer or shooter would use the invention by first mounting the sight to the bow utilizing the standard IBO bolt holes. The shooter would then aim at the target with the point of the top sight pin. After the shot, the shooter would loosen either of the securing bolts and use the micro-gang adjustment bolts to move the pin housing and thus the top sight pin to where the arrow is impacting. The top pin should correspond to the vertical impact point of its corresponding yardage number. The micro-adjustment bolt can be utilized to fine-tune the sight pin. Once the arrow is impacting precisely at the tip of top sight pin at its corresponding yardage, the remaining pins below should be sighted in. These pins only require elevation adjustment. These adjustments are performed utilizing the individual micro-adjustment bolts that correspond to their yardage number. Once all of the sight pins are sighted in, all of the securing bolts should also be tight so that the entire assembly is secure. The sight can then be utilized for target shooting or hunting at various yardage points.

FIGS. 7A-7D are detailed figures showing the structure of a typical rear sight pin of the present invention. FIG. 7A is a perspective view of a rear sight pin removed from the assembly of the point bow sight. Rear sight pin 52 generally comprises sight pin body 56 having a front face 60 and a point edge 54. Positioned through body 56 are a number of micro-adjusted holes 58, the function of which is described above.

Sight pin coating 62 comprises an opaque, preferably black, coating over the front face 60 of sight pin 52 that forms both yardage number indicia 64 and aiming point indicia 66. This structure is seen best in FIG. 7B and shows the presentation of the sight pin to the archer during use. FIG. 7C is a top plan view of the rear sighting pin 52 of the present invention, while FIG. 7D is an end plan view of the rear sight pin 52 of the present invention. In FIG. 7D, pin securing aperture 68 is shown positioned to receive one of the pin securing bolts 36 as described above.

Figure 8A:
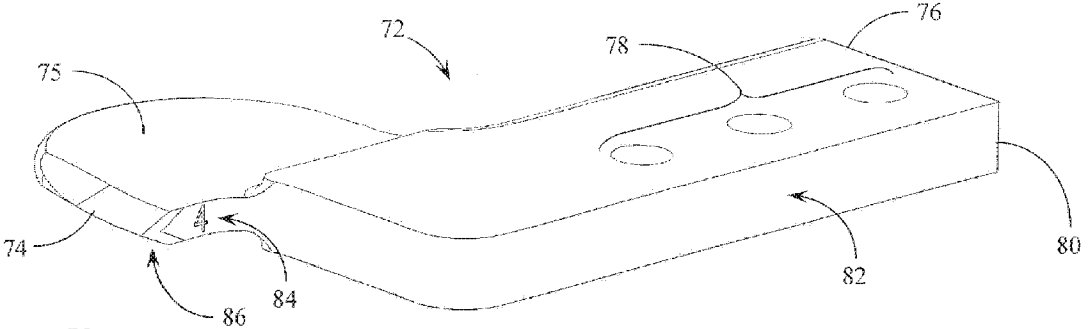
FIGS. 8A-8D are detailed views of a typical front sight pin structure of the point bow sight device of the present invention.

FIGS. 8A-8D are detailed figures showing the structure of a typical front sight pin of the present invention. FIG. 8A is a perspective view of a front sight pin removed from the assembly of the point bow sight. Front sight pin 72 generally comprises sight pin body 76 having a front face 80 and a point edge 74. Positioned through body 76 are a number of micro-adjusted holes 58, the function of which is described above.

Figure 8D:
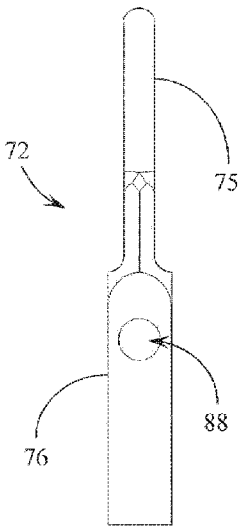
Figure 8C:
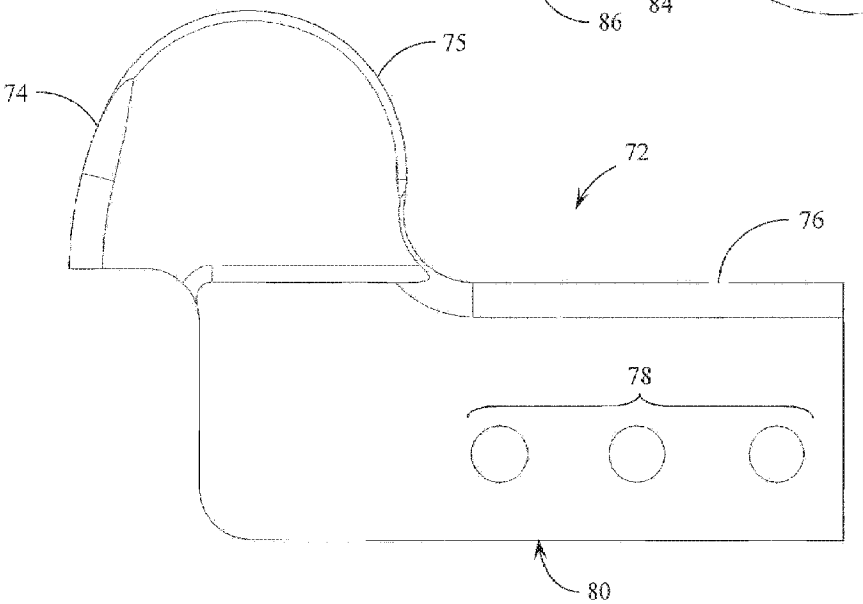
Figure 8B:
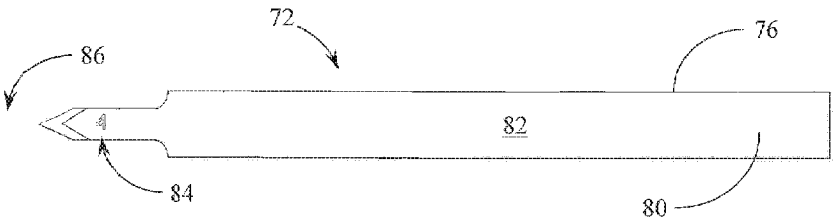

Sight pin coating 82 comprises an opaque, preferably black, coating over the front face 80 of sight pin 72 that forms both yardage number indicia 84 and aiming point indicia 86. This structure is seen best in FIG. 8B and shows the presentation of the sight pin to the archer during use. FIG. 8C is a top plan view of the rear sighting pin 72 of the present invention, while FIG. 8D is an end plan view of the rear sight pin 72 of the present invention. In FIG. 8D, pin securing aperture 88 is shown positioned to receive one of the pin securing bolts 56 as described above.

Although the present invention has been described in terms of the foregoing preferred embodiments, this description has been provided by way of explanation only, and is not intended to be construed as a limitation of the invention. Those skilled in the art will recognize modifications in the present invention that might accommodate specific bow structures and specific forms of archery. Such modifications as to structure, size, and even the specific arrangement of components, where such modifications are coincidental to the type of bow or type of archery, do not necessarily depart from the spirit and scope of the invention.

We claim:

1. A bow sight for use by an archer in conjunction with a bow having a stock, the bow sight comprising:

a riser mount for securing the bow sight to the bow stock;

a gang adjustment bracket adjustably connected to the riser mount;

a pin housing adjustably connected to the gang adjustment bracket, the pin housing comprising:

a support and adjustment frame comprising a plurality of micro-adjustment bolts;

a sight window frame extending from the support and adjustment frame, the sight window frame defining an open window through which the archer may sight a target; and a plurality of sight pins, each sight pin comprising a plate structure of light gathering material extending from a support position within the support and adjustment frame to a point edge within the open window of the sight window frame;

wherein each of the plurality of sight pins engages one of the plurality of micro-adjustment bolts, the plurality of sight pins forming a stack extending into the sight window frame presenting a vertically aligned column of illuminated points representing yardage distances to a target.

2. The bow sight of claim 1 wherein the support and adjustment frame further comprises a plurality of pin securing bolts and wherein each of the plurality of sight pins engages one of the plurality of pin securing bolts.

3. The bow sight of claim 1 wherein the plurality of sight pins comprises two sets of interleaved sight pins creating a common plane of vertically aligned point edges.

4. The bow sight of claim 3 wherein the two sets of interleaved sight pins comprise:

a forward positioned set of sight pins, each of the forward sight pins comprising an adjustment plate region and a light gathering point edge region; and a rearward positioned set of sight pins, each of the rearward positioned sight pins comprising an adjustment plate region and a light gathering point edge region.

5. The bow sight of claim 4 wherein the adjustment plate regions of the forward positioned set of sight pins are vertically aligned and stacked within the support and adjustment frame and the adjustment plate regions of the rearward positioned set of sight pins are vertically aligned and stacked apart from the forward positioned set of sight pins within the support and adjustment frame.

6. The bow sight of claim 4 wherein the light gathering regions of the forward positioned set of sight pins are offset towards the rearward positioned set of sight pins whereby the light gathering regions of both the forward and rearward sets of sight pins are vertically aligned and stacked within the sight window frame.

7. The apparatus of claim 4 wherein the two sets of interleaved sight pins comprise two sets of three sight pins.

8. The bow sight of claim 7 wherein the plurality of micro-adjustment bolts comprises two sets of three adjustment bolts.

9. The bow sight of claim 8 wherein a first set of micro-adjustment bolts modify the vertical positioning of the forward positioned set of sight pins, and the second set of micro-adjustment bolts modify the vertical position of the rearward positioned set of sight pins.

10. The bow sight of claim 7 wherein the support and adjustment frame further comprises a plurality of pin securing bolts and wherein each of the plurality of sight pins engages one of the plurality of pin securing bolts.

11. The bow sight of claim 10 wherein the plurality of pin securing bolts comprises two sets of three securing bolts.

12. The bow sight of claim 11 wherein a first set of pin securing bolts secure the vertical positioning of the forward positioned set of sight pins, and the second set of pin securing bolts secure the vertical position of the rearward positioned set of sight pins.

13. The bow sight of claim 1 wherein the plurality of sight pins further comprise number indicia adjacent the point edge of each.

14. The bow sight of claim 1 wherein the sight window frame further comprises a rail mounting member positioned to receive an accessory device.

15. The bow sight of claim 14 wherein the rail mounting member comprises a Picatinny rail structure.

16. The bow sight of claim 1 wherein the light gathering material comprises an acrylic polymer material.

17. The bow sight of claim 16 wherein the acrylic polymer material comprises a fluorescent dyed polymer material.

18. A targeting sight for use with an aimed device, the targeting sight comprising:

a pin housing adjustably connected to the aimed device, the pin housing comprising:

a support and adjustment frame comprising a plurality of micro-adjustment bolts and a plurality of pin securing bolts;

a sight window frame extending from the support and adjustment frame, the sight window frame defining an open window through which the user may sight a target; and a plurality of sight pins, each sight pin comprising a plate structure of light gathering material extending from a support position within the support and adjustment frame to a point edge within the open window of the sight window frame, the plurality of sight pins comprising two sets of interleaved sight pins creating a common plane of vertically aligned point edges, the plurality of sight pins comprising:

a forward positioned set of sight pins, each of the forward sight pins comprising an adjustment plate region and a light gathering point edge region; and a rearward positioned set of sight pins, each of the rearward positioned sight pins comprising an adjustment plate region and a light gathering point edge region;

wherein each of the plurality of sight pins engages one of the plurality of micro-adjustment bolts and one of the plurality of pin securing bolts, the plurality of sight pins forming a stack extending into the sight window frame presenting a vertically aligned column of illuminated points representing yardage distances to a target.

19. The targeting sight of claim 18 wherein the adjustment plate regions of the forward positioned set of sight pins are vertically aligned and stacked within the support and adjustment frame and the adjustment plate regions of the rearward positioned set of sight pins are vertically aligned and stacked apart from the forward positioned set of sight pins within the support and adjustment frame.

20. The bow sight of claim 18 wherein the light gathering regions of the forward positioned set of sight pins are offset towards the rearward positioned set of sight pins whereby the light gathering regions of both the forward and rearward sets of sight pins are vertically aligned and stacked within the sight window frame.

* * * * *